US005282618A

United States Patent [19]

Hong

[11] Patent Number: 5,282,618

[45] Date of Patent: Feb. 1, 1994

[54] RACKET WITH IMPROVED SHOCK-ABSORBING MEANS

[75] Inventor: Arthur Hong, Taichung, Taiwan

[73] Assignees: Bonny Sports Corp.; Prince Manufacturing Taiwan Ltd., both of Taichung, Taiwan

[21] Appl. No.: 904,093

[22] Filed: Jun. 25, 1992

[51] Int. Cl.[5] ..... A63B 49/08

[52] U.S. Cl. ..... 273/73 J; 273/81 R

[58] Field of Search ..... 273/67 R, 73 R, 73 J, 273/75, 81 R

[56] References Cited

U.S. PATENT DOCUMENTS

| | | | |
|---|---|---|---|
| Re. 20,684 | 4/1938 | Dickson | 273/73 J |
| 1,523,638 | 1/1925 | Freedlander et al. | 273/73 J |
| 1,617,243 | 2/1927 | Flanagan | 273/67 R |
| 3,638,943 | 2/1972 | Snawwaert | 273/73 J |
| 4,033,583 | 7/1977 | Ehrhart | 273/73 J X |
| 4,609,198 | 9/1986 | Tarr | 273/73 J |
| 4,732,384 | 3/1988 | Seymour | 273/73 J X |
| 4,736,949 | 4/1988 | Muroi | 273/73 J |
| 4,989,871 | 2/1991 | Sheng | 273/73 J X |

FOREIGN PATENT DOCUMENTS

| | | | |
|---|---|---|---|
| 2230458 | 10/1990 | United Kingdom | 273/73 J |

*Primary Examiner*—William Stoll

*Attorney, Agent, or Firm*—Browdy and Neimark

[57] ABSTRACT

A game racket is provided with an elastic shock-absorbing body, which is attached to the front end of hand grip of the racket and has a tapered body with an axial hole dimensioned to receive therein the bottom end of the shaft of the racket. The shock-absorbing body further has a receiving portion of annular profile extending therefrom in a direction toward the hand grip so as to wrap the front end of the hand grip of the racket. The elastic shock-absorbing body provides the game racket with a greater power of striking a ball and with a better capability of absorbing the shock generated by impact of a ball.

3 Claims, 2 Drawing Sheets

RACKET WITH IMPROVED SHOCK-ABSORBING MEANS

BACKGROUND OF THE INVENTION

The present invention relates to a sports racket, and more particularly to a racket having a hand grip provided with an elastic shock-absorbing body.

As shown in FIG. 1, a conventional racket 10 of the prior art is composed of a head portion 11, a shaft 13 of a predetermined length extending vertically and downwardly from the bottom end of the head portion 11, and a hand grip 14 fastened securely to the shaft 13. A tapered sleeve 15 of plastic material is attached to the front end of the hand grip 14 and provided at the tapered end thereof with a hole intended to receive the shaft 13. As hand grip 14 and sleeve 15 are attached to form a united body, the actual elastic length L of the shaft 13 is that portion which begins with the tapered end of the sleeve 15 and ends at the bottom end of the head portion 11. With the profiles and the material qualities of head portion 11, shaft 13 and hand grip 14 being equal, the quantity of striking power of the racket 10 is dependent on the elastic length L of the shaft 13. In other words, the shaft 13 having a greater elastic length L provides a proportionally greater power to strike a ball, thereby resulting in a greater counter reactional force which exerts on the hand holding the racket. It is well known that a player's action to strike a ball can be seriously hampered by a racket having an excessively long shaft. Therefore, a player should choose a racket that is most suitable in consideration of his or her body figure and height.

SUMMARY OF THE INVENTION

It is, therefore, the primary objective of the present invention to provide a racket of conventional size with a shaft having a greater elastic length so as to enhance its power of striking a ball and to mitigate its counter reactional force.

In keeping with the principles of the present invention, the primary objective of the present invention is accomplished by a racket provided with an elastic shock-absorbing body, which is disposed in a sleeve attached to the hand grip and intended to serve dual purposes that it increases effectively the elastic length of the shaft so as to provide a greater striking power, and that it works as a cushion to absorb shock and to reduce the counter reactional force that exerts on the player's hand holding the racket.

The foregoing objective, features and functions of the present invention will be better understood by studying the following detailed description of two preferred embodiments of the present invention, in conjunction with the drawings provided herewith.

DETAILED DESCRIPTION OF THE PREFERRED EMBODIMENTS

Figure 2:
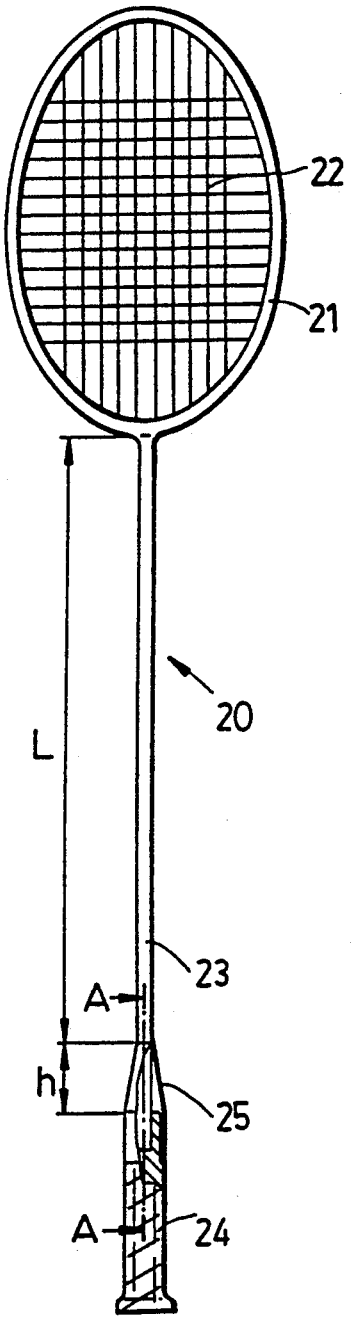
FIG. 2 shows a plan view of a first preferred embodiment of the present invention.
Figure 1:
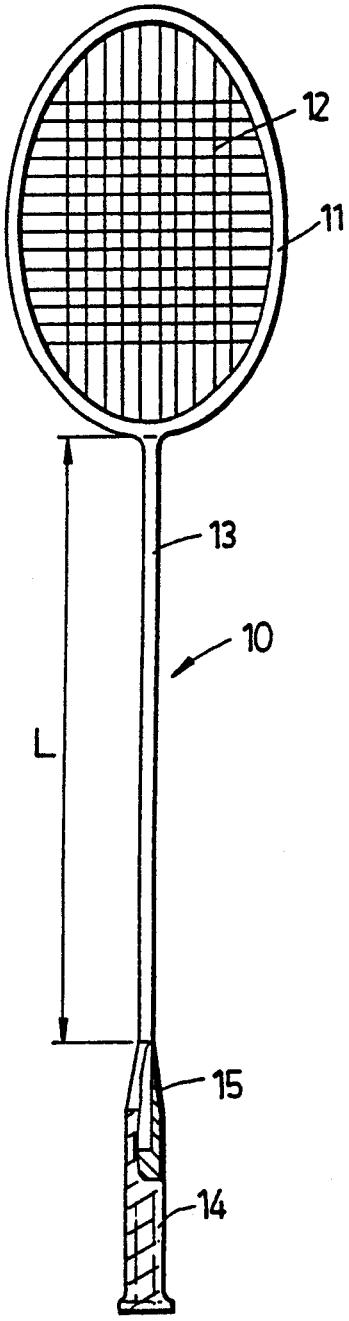
FIG. 1 PRIOR ART
FIG. 1 shows a schematic view of a conventional racket of the prior art.
Figure 3:
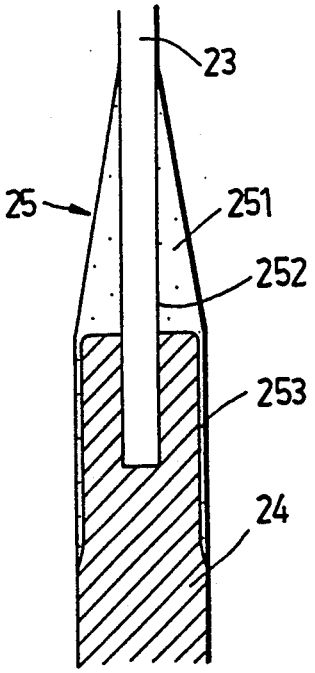
FIG. 3 shows a sectional view of a portion taken along the line A—A as shown in FIG. 2.
Figure 4:
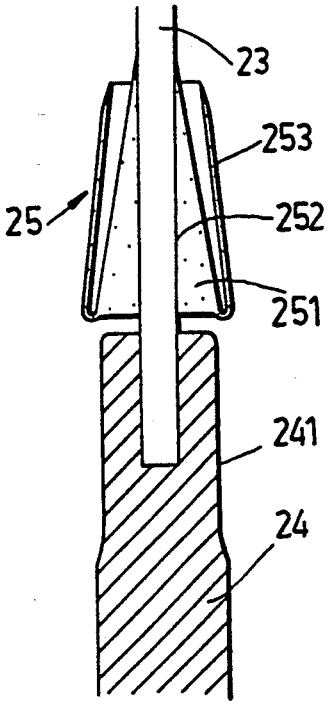
FIG. 4 shows a schematic view of constructing the first preferred embodiment of the present invention.

Referring to FIGS. 2, 3 and 4, a sports racket 20 embodied in the first preferred embodiment of the present invention is shown comprising a head portion 21, a stringed surface 22, a shaft 23, and a hand grip 24. The racket 20 of the present invention differs from the prior art racket in that it is provided with an elastic shock-absorbing body 25 disposed at the front end of the hand grip 24. The elastic shock-absorbing body 25 of rubber or neoprene material has a tapered body 251 provided with a centrally-located axial hole 252 intended to receive therein the shaft 23. The tapered body 251 is further furnished with a receiving portion 253 of annular profile, which extends from the bottom thereof and is so dimensioned as to fit over the front end portion of the hand grip 24.

In combination, the shaft 23 is first fitted into the axial hole 252 of the shock-absorbing body 25. The receiving portion 253 of the tapered body 251 is lifted outwards to expose the bottom portion of the tapered body 251 so as to facilitate the fastening of the hand grip 24 to the bottom end of the shaft 23. An adhesive may be used for such fastening if the hand grip 24 is of wooden material. If the hand grip 24 is made from polyurethane, the shaft 23 may be placed in a molding tool, in which the shaft 23 and the hand grip 24 are made integrally by injection molding. The hand grip 24 is provided at the front end thereof with a recessed portion 241 intended to ensure that the receiving portion 253 of the shock-absorbing body 25 is firmly secured to the hand grip 24. As soon as the hand grip 24 is fastened to the shaft 23, push the shock-absorbing body 25 in a direction toward the hand grip 24. Thereafter, the receiving portion 253, which was previously lifted outwards, is pulled back to its original position so as to enclose the recessed portion 241 of the hand grip 24. The depth of the recessed portion 241 is dependent on the thickness of the receiving portion 253 of the shock-absorbing body 25.

The shock-absorbing body 25 is extremely elastic and is not fastened fixedly with the shaft 23. In fact, the end of the shaft 23 extends into the hand grip 24, as shown in FIGS. 3 and 4. As a result, the elastic length of the shaft 23 includes the length h of the shock-absorbing body 25, in addition to the elastic length L of the shaft 23. In other words, the game racket 20 of the present invention is provided with an overall elastic length of L+h, which enhances effectively the ball-striking power of the racket 20. In addition, the shock wave that is transmitted downwards from the head portion 21 is effectively absorbed by the shock-absorbing body 25 before reaching the hand grip 24. Therefore, the player's hand holding the hand grip 24 is not subjected to an injury known as a tennis elbow.

Figure 5:
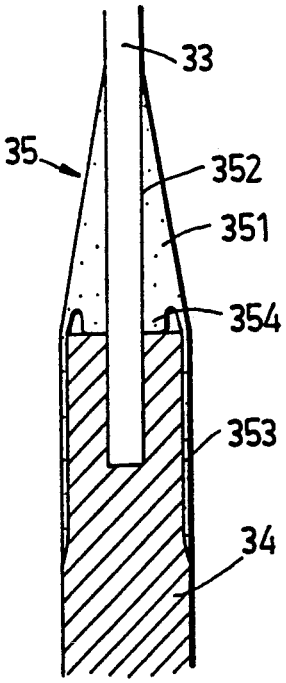
FIG. 5 shows a sectional view of a second preferred embodiment of the present invention.
Figure 6:
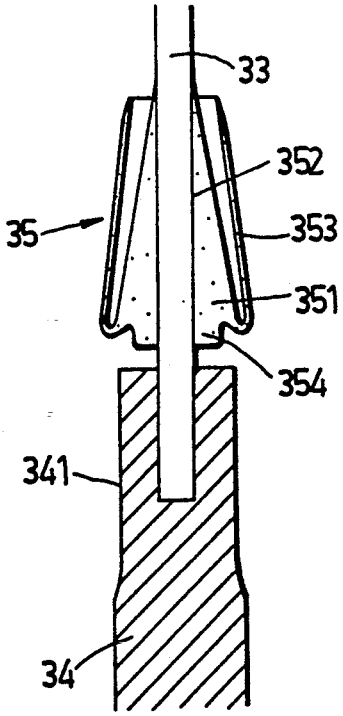
FIG. 6 shows a schematic view of constructing the second preferred embodiment of the present invention.

Now referring to FIGS. 4 and 5, a second embodiment of the present invention is basically similar in structure to the first embodiment as described above, with the only difference being that the shock-absorbing body 35 of the second embodiment has a tapered body 351 provided with a shoulder 354 and an axial hole 352 passing through the shoulder 354. In combination, the receiving portion 353 of the shock-absorbing body 35 is first lifted outwards before fastening the hand grip 34 to the bottom end of the shaft 33. Thereafter, the shock-absorbing body 35 is moved in a direction toward the hand grip 34 so that the bottom surface of shoulder 354 is engaged tightly against the top of the hand grip 34. The receiving portion 353 of the shock-absorbing body 35 is then pulled back to its original position so as to enclose tightly the recessed portion 341 of the hand grip 34. As a result, the shock-absorbing body 35 is firmly united with the hand grip 34.

The embodiments of the present invention described above are to be regarded in all respects as merely illustrative and not restrictive. Accordingly, the present invention may be embodied in other specific forms without deviating from the spirit thereof. The present invention is therefore to be limited by the scope of the hereinafter appended claims.

What is claimed is:

1. A racket with improved shock-absorbing means comprising a head portion having a stringed surface, a shaft extending downwards from a bottom portion of said head portion, and a hand grip fastened to a bottom end of said shaft, said racket comprising, an elastic shock-absorbing means for absorbing impacts on said head portion, said shock-absorbing means having a tapered body with an axial hole having a constant diameter therethrough, said axial hole dimensioned to engage therein said bottom end of said shaft;

said shock-absorbing means further having a receiving portion with a circular cross section substantially equal to a circular cross section of said upper end of said hand grip and extending from said shock-absorbing means to cover an upper end and side of said hand grip, and said upper end and side of said hand grip engaged in said receiving portion and to said bottom end of said shaft.

2. The racket with improved shock-absorbing means of claim 1, wherein said tapered body of said shock-absorbing means has a shoulder at an upper end of said receiving portion, a face of said shoulder being parallel to a top end face of said hand grip, said face of said shoulder and said top end face being engaged when said upper end of said hand grip is engaged in said receiving portion.

3. The racket with improved shock-absorbing means of claim 1, wherein said upper end of said hand grip has a recessed portion corresponding to said receiving portion.

* * * * *